US010082347B2

(12) United States Patent
Arnott et al.

(10) Patent No.: US 10,082,347 B2
(45) Date of Patent: Sep. 25, 2018

(54) MOUNTING ASSEMBLY FOR MOUNTING HEAT EXCHANGER

(71) Applicant: DENSO Marston Ltd., West Yorkshire (GB)

(72) Inventors: Keiron Arnott, West Yorkshire (GB); Sam Bailey, West Yorkshire (GB)

(73) Assignee: DENSO Marston Ltd., West Yorkshire (GB)

( * ) Notice: Subject to any disclaimer, the term of this patent is extended or adjusted under 35 U.S.C. 154(b) by 38 days.

(21) Appl. No.: 15/433,094

(22) Filed: Feb. 15, 2017

(65) Prior Publication Data

US 2017/0248380 A1 Aug. 31, 2017

(30) Foreign Application Priority Data

Feb. 26, 2016 (GB) ..... 1603384.7

(51) Int. Cl.

| | |
|---|---|
| ***F28F 9/007*** | (2006.01) |
| ***F28F 9/013*** | (2006.01) |
| ***F28F 9/10*** | (2006.01) |
| ***F28D 1/053*** | (2006.01) |
| *F28D 21/00* | (2006.01) |

(52) U.S. Cl.

CPC ..... *F28F 9/0131* (2013.01); *F28D 1/05316* (2013.01); *F28F 9/007* (2013.01); *F28F 9/10* (2013.01); *F28D 2021/008* (2013.01)

(58) Field of Classification Search

CPC .. F16F 1/38; F16F 1/3835; F16F 1/387; F16F 13/00; B60G 2204/41; B60G 2204/4104; F28F 9/007

USPC .... 267/140.12, 141, 141.2, 141.4, 292, 293; 165/67, 149

See application file for complete search history.

(56) References Cited

U.S. PATENT DOCUMENTS

| | | | | |
|---|---|---|---|---|
| 1,374,394 A * | 4/1921 | Ross | B60R 19/52 180/68.4 |
| 1,720,432 A * | 7/1929 | Pampinella | B60G 11/42 267/269 |
| 4,540,044 A * | 9/1985 | Lenz | F28F 9/001 165/149 |
| 4,984,928 A * | 1/1991 | Domer | F16F 1/387 403/225 |

(Continued)

FOREIGN PATENT DOCUMENTS

| | | |
|---|---|---|
| DE | 2703038 A * | 7/1978 |
| DE | 102013014663 B3 | 11/2014 |

*Primary Examiner* — Allen Flanigan

(57) ABSTRACT

A mounting assembly for mounting a heat exchanger comprises an elongate member defining a screw threaded axial bore at each end, and a bolt for each screw threaded bore. The assembly further comprises two elastomeric parts each being substantially top hat shaped and defining an axial bore to receive one end of the elongate member, such that the assembly can be mounted between two apertured mounting parts by arranging the heat exchanger between the mounting parts, with the elongate member received in a bore through the heat exchanger, and tightening the bolts so that the mounting part is clamped between the end of the elongate member and the bolt head, with the elastomeric parts mounting the mounting assembly in the heat exchanger bore so that resilient compression of the elastomeric parts allows movement of the heat exchanger with respect to the elastomeric parts.

20 Claims, 9 Drawing Sheets

(56) References Cited

U.S. PATENT DOCUMENTS

| | | | | |
|---|---|---|---|---|
| 5,228,511 | A * | 7/1993 | Boquel | F28F 9/001 165/149 |
| 7,441,620 | B2 * | 10/2008 | Riniker | B60K 11/04 165/178 |
| 2007/0272460 | A1 * | 11/2007 | Riniker | B60K 11/04 180/68.4 |

* cited by examiner

MOUNTING ASSEMBLY FOR MOUNTING HEAT EXCHANGER

CROSS REFERENCE TO RELATED APPLICATION

This application is based on UK Patent Application No. 1603384.7 filed on Feb. 26, 2016, the disclosure of which is incorporated herein by reference.

TECHNICAL FIELD

The disclosure relates to a mounting assembly for mounting a heat exchanger.

BACKGROUND

Heat exchangers are used in vehicles, including off highway vehicles. All vehicles with internal combustion engines produce vibration. In order to prevent damage to the heat exchanger from vibration, it is beneficial if the heat exchanger is mounted tightly in place. However, as the heat exchanger heats up and cools down during use, it will undergo thermal expansion and contraction. If it is held tightly in position, this expansion and contraction over time can result in fatigue failure.

It is known to mount a heat exchanger between two plates of a steel support channel. The heat exchanger has a steel sleeve extending through the header tank. A long through bolt extends through the steel sleeve and through apertures in the plates of the support channel so that the free end protrudes from the far end of the header tank and receives a nut. A washer is provided at each end of the large through bolt so that one washer lies between the head of the large through bolt and one support plate, and the other washer lies between the nut and the other support plate. In this way the tightening of the nut secures the heat exchanger to the support channel.

SUMMARY

According to one aspect of the disclosure there is provided a mounting assembly for mounting a heat exchanger, the assembly comprising an elongate member, the elongate member defining a screw threaded axial bore at each end, and a bolt for each screw threaded bore, and two elastomeric parts, each elastomeric part being substantially top hat shaped and defining an axial bore to receive one end of the elongate member, such that the assembly can be mounted between two apertured mounting parts by arranging the heat exchanger between the mounting parts, with the elongate member received in a bore through the heat exchanger, and tightening the bolts so that the mounting part is clamped between the end of the elongate member and the bolt head, with the elastomeric parts mounting the mounting assembly in the heat exchanger bore so that resilient compression of the elastomeric part allows movement of the heat exchanger with respect to the elastomeric parts.

In this way, transmission of vibration to the heat exchanger is reduced by the elastomeric parts, while the elastomeric parts allow thermal expansion of the heat exchanger and contraction to prolong fatigue life.

The elongate member may be a solid bar, and may be a round cross section bar.

Each elastomeric part may carry a washer on the end of the flange thereof. The washer preferably defines an aperture which is smaller than the axial bore of the elastomeric part and smaller than the cross section of the elongate member. The mounting assembly may also or alternatively include a washer to be arranged between the head of the bolt and the mounting part at each end.

The top hat shaped elastomeric part comprises a main body and a flange, and one side of the main body of the elastomeric part may have a lower thickness than the other. The side with lower thickness may define a part elliptical outer surface in cross section. This allows a greater range of movement. The elliptical surface reduces the wall thickness by no more than 80% and no less than 50% in relation to the thickness of the other part of the wall, and may reduce the wall thickness by 65%. The thickness at its thinnest may be from 0.5 to 1.25 mm, and preferably is in the range 0.65 to 0.85 mm. The side with lower thickness may include a protrusion, and at the protrusion the thickness may be the same as the other side. The protrusion therefore supports the elongate member so that it is central within the heat exchanger bore, as the axial bore of the elastomeric part will be coaxial with the axis of the heat exchanger bore. The protrusion may extend over less than half of the axial length of the main body, preferably over less than a quarter of the length from the flange.

The heat exchanger and the elastomeric part may define a key and key way to ensure that the elastomeric part is correctly oriented with respect to the heat exchanger about the axis of the bore. In that regard, the flange may include a flat and be aligned with a complementary shaped part on the heat exchanger.

According to another aspect of the disclosure, there is provided a mounting assembly according to the first aspect of the disclosure and a heat exchanger, the heat exchanger defining a tube to receive the elongate member.

One of the tube and an elastomeric part may include a key and the other may include a keyway. In one embodiment, the elastomeric part includes a flat and the tube includes a protrusion with a flat surface to interengage in complementary fashion.

The elongate member, elastomeric members and tube are preferably dimensioned such that when assembled, there is a gap at each end of the assembly between the washer carried by the elastomeric member and the end face of the elongate member.

The gap between the end face of the elongate member and the inner face of the washer may be 0.5 to 2 mm or 0.55 to 1.65 mm and preferably is in the range 0.9 to 1.1 mm.

According to a further aspect of the disclosure, there is provided a method of preparing a mounting assembly for a heat exchanger, the mounting assembly being according to the first aspect of the disclosure, wherein the elongate member is a standard metal member, the method including cutting the standard metal member to be the desired length to fit into a tube defined in the heat exchanger.

The elongate member may be a solid metal bar, such as a round cross section bar. In that case, the method may further comprise the steps of, after the bar has been cut, boring a bore in each end of the bar, and tapping a screw thread into each bore.

BRIEF DESCRIPTION OF THE DRAWINGS

An embodiment of the disclosure will now be described by way of example and with reference to the accompanying drawings, in which.

DETAILED DESCRIPTION

Figure 1:
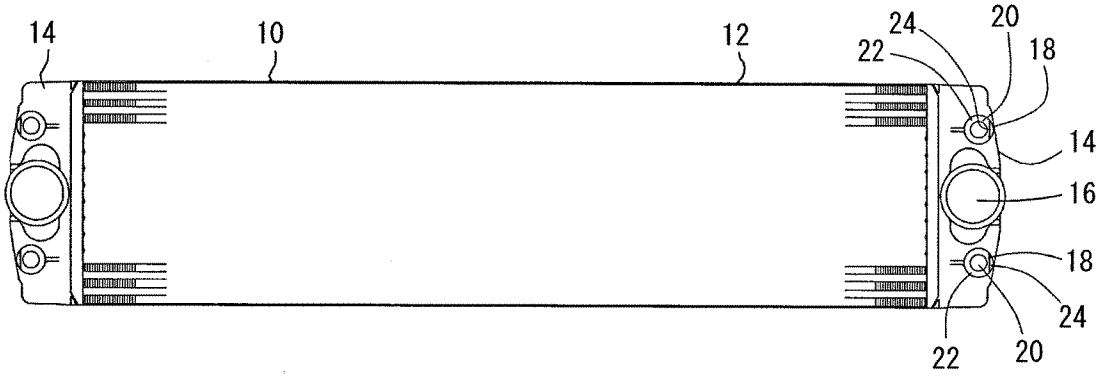
FIG. 1 is a front elevation of a heat exchanger of the embodiment.
Figure 2:
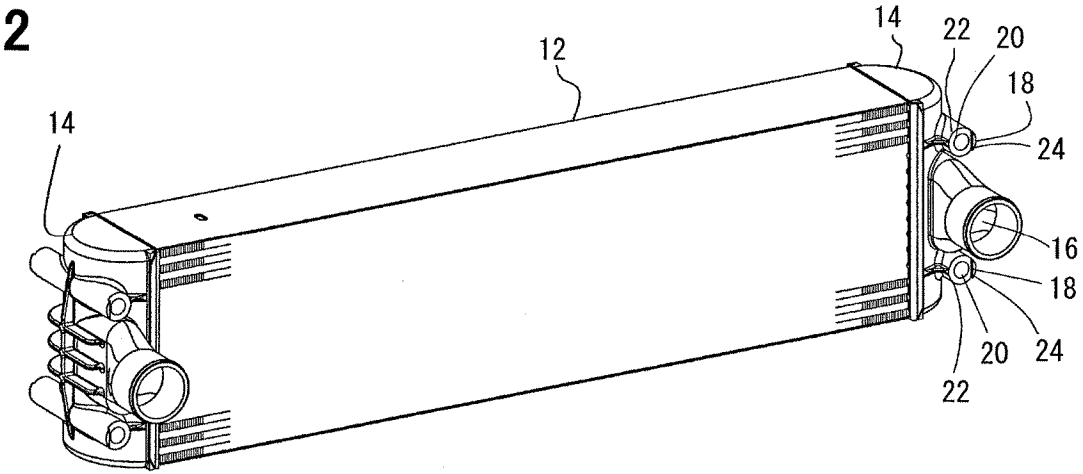
FIG. 2 is a front perspective view of the heat exchanger of FIG. 1.
Figure 3:
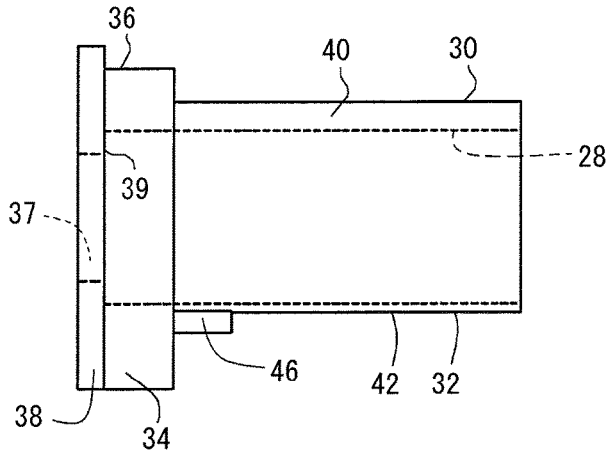
FIG. 3 is a side elevation of an elastomeric part of the embodiment.

The heat exchanger 10 of the embodiment comprises a core 12 with a header tank 14 at each end. The core 12 may comprise tubes and fins. Each header tank 14 includes a broad opening 16 forming an inlet or an outlet. To each side of the broad opening 16 a tube 18 is provided which defines a mounting bore 20. The front face 22 of the tube 18 is machined away to leave a flat bottomed protruding key (protrusion) 24.

Figure 4:
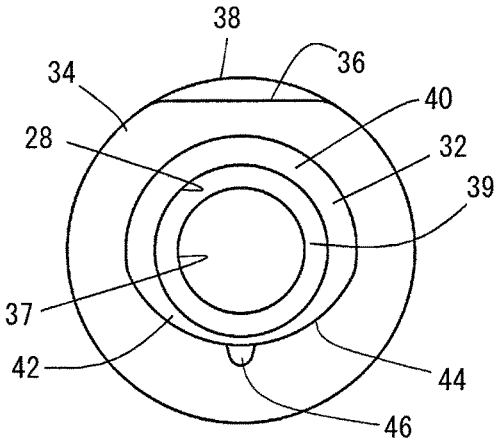
FIG. 4 is an end elevation of the elastomeric part of FIG. 3.
Figure 5:
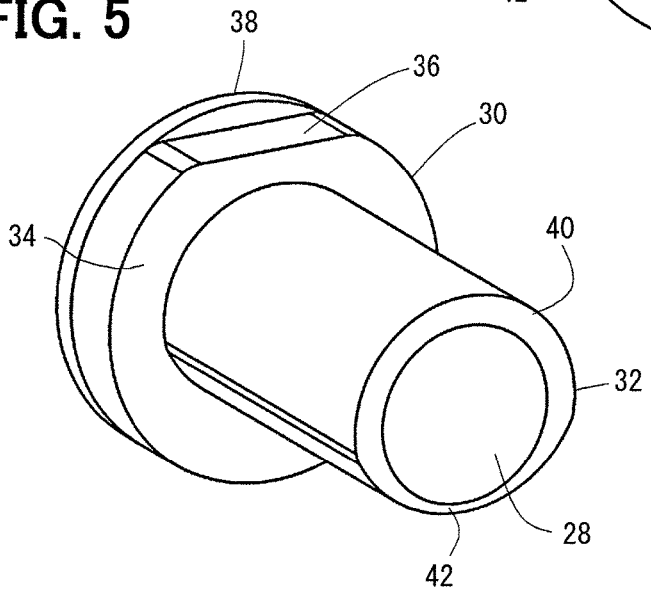
FIG. 5 is a perspective view of the elastomeric part of FIG. 3.
Figure 6:
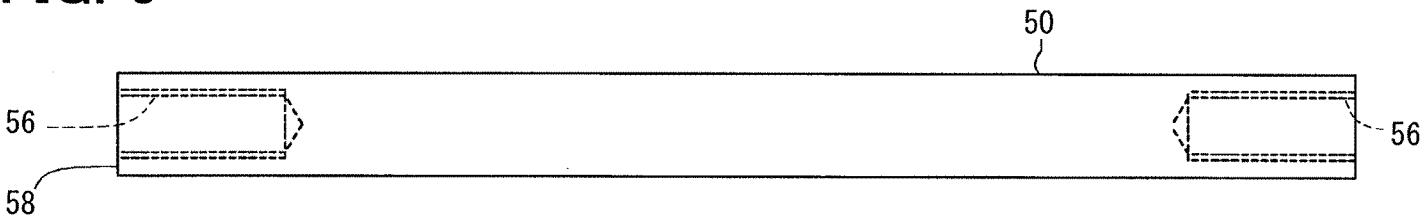
FIG. 6 is a side elevation of an elongate member of the embodiment.
Figure 7:
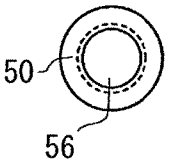
FIG. 7 is an end elevation of the elongate member of FIG. 6.
Figure 8:
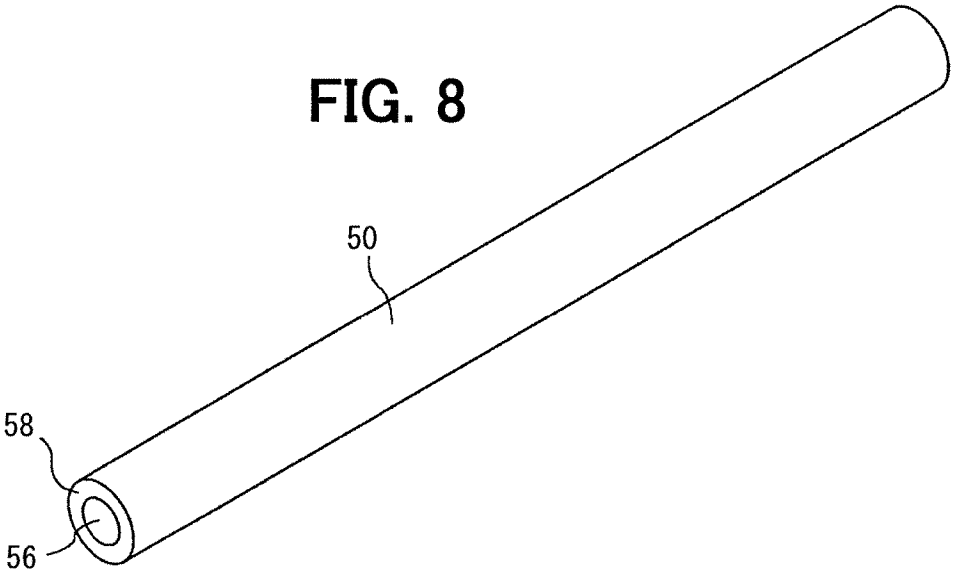
FIG. 8 is a perspective view of the elongate member of FIG. 6.

Each bore 20 receives an elastomeric part 30 made of elastomeric material. The elastomeric part 30 is generally top hat shaped, comprising a main part (tubular part) 32 which is generally tubular and a flange 34 at one end. The elastomeric part 30 has a bore 28 therethrough. A flat 36 is provided at the top of the flange 34 which is otherwise circular. A circular washer 38 is moulded to the rear of the flange 34. The aperture 37 in the circular washer 38 is coaxial with the bore 28, but a smaller diameter so that an annulus of the inner face 39 of the washer 38 faces into the bore 28. The upper half 40 of the tubular part 32 is of constant thickness, but the lower half is tapered to reach a minimum thickness at the bottom of the tubular part 32. To achieve this, the lower surface 42 of the tubular part 32 follows the form of an elliptical curve as shown in particular in FIGS. 4 and 5. The elliptical profile reduces the wall thickness by no more than 80% and no less than 50% in relation to the wall thickness of the top half, in this case by 65%. The thickness of the tubular part 32 of the elastomeric part 30 at its thinnest is 0.75 mm, but could be from 0.5 to 1.25 mm. A protrusion 46 is provided extending from the underside (elliptical surface, lower surface) 42 of the tubular part 32 and from the flange 34. The protrusion 46 extends over less than a quarter of the length of the tubular part 32.

Figure 18:
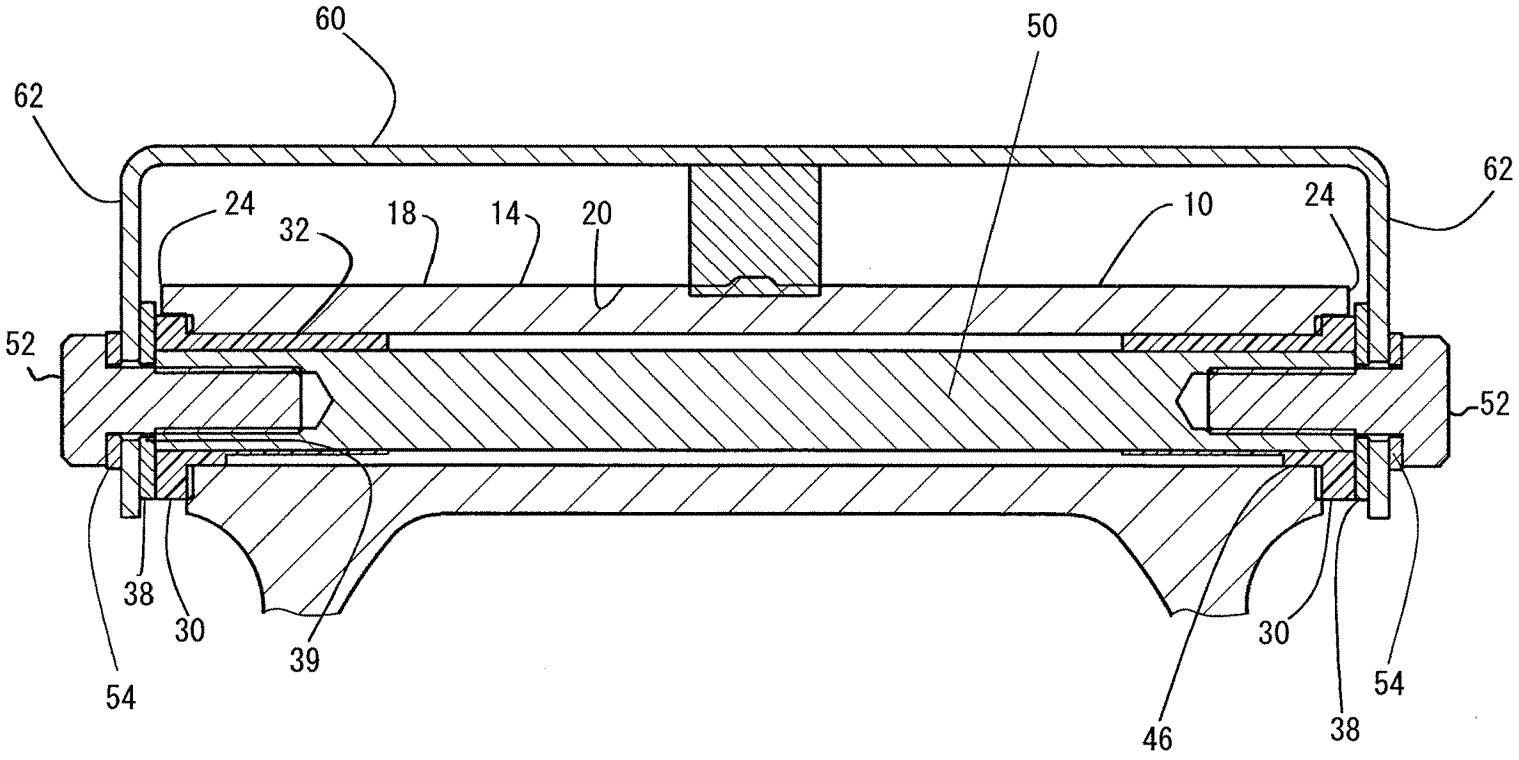

Two elastomeric parts 30 form part of the mounting assembly which also includes an elongate member 50, two bolts 52 and two washers 54, as shown in FIG. 18. Each bolt 52 may be of a standard size such as M8, M10 or M12.

The elongate member 50 is in the form of a circular cross section bar which is solid except for a screw threaded axial bore (screw threaded bore) 56 at each end.

Figure 9:
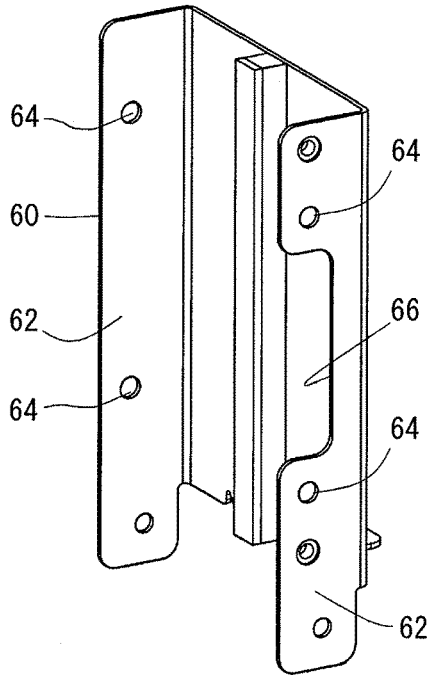
FIG. 9 is a perspective view of a supporting channel.
Figure 10:
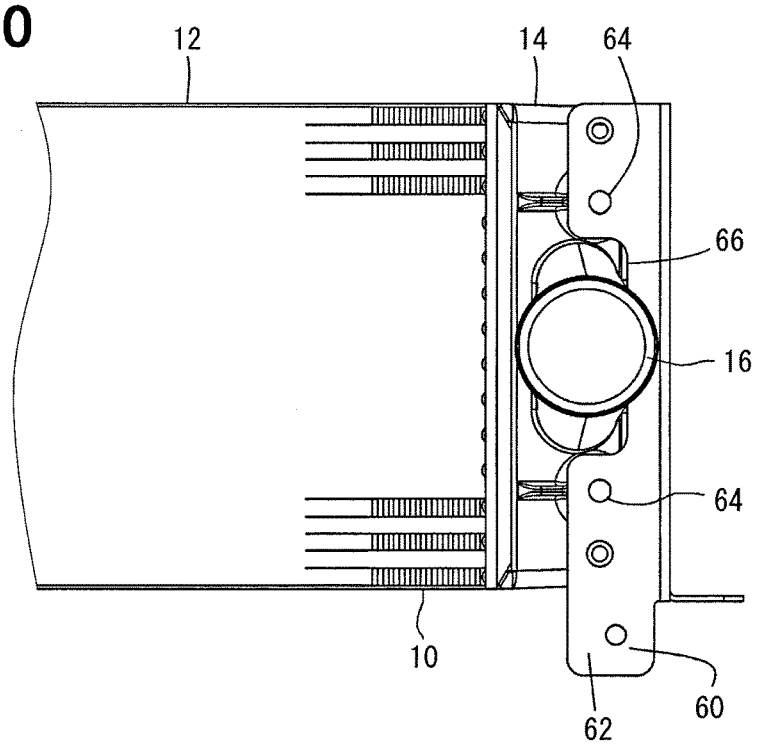
FIG. 10 is a front elevation of the heat exchanger of the embodiment offered up to the channel.
Figure 11:
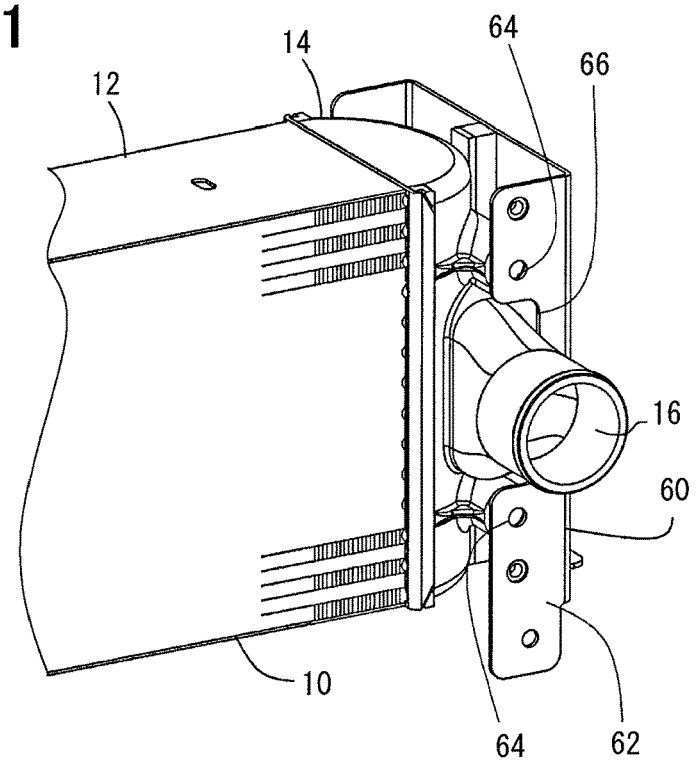
FIG. 11 is a perspective view of the heat exchanger of the embodiment offered up to the channel.
Figure 12:
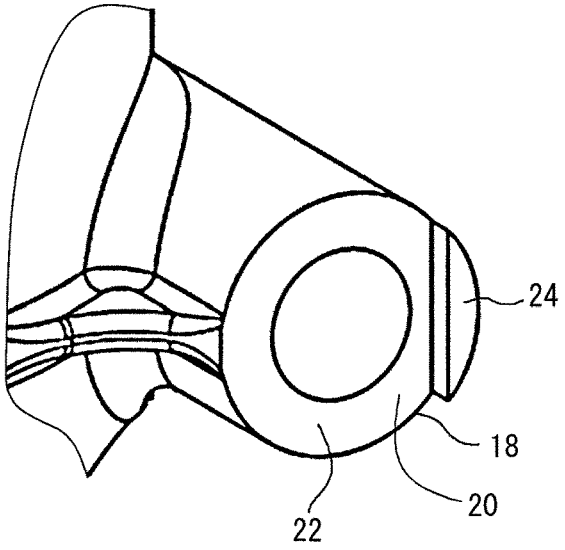
FIG. 12 is a detail perspective view of one end of a mounting tube of the header tank of the heat exchanger.
Figure 13:
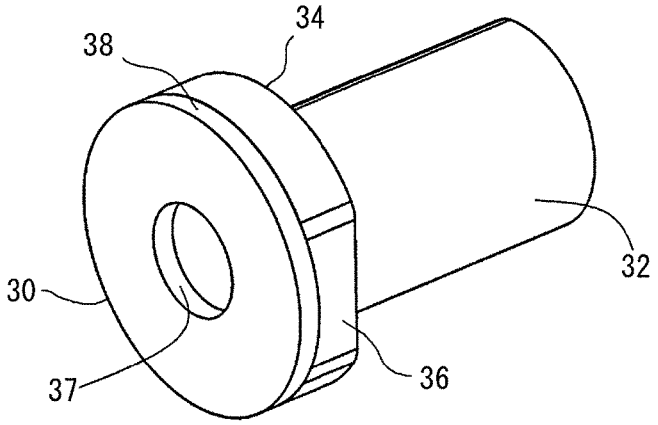
FIG. 13 is a rear perspective view of the elastomeric part of the embodiment.
Figure 14:
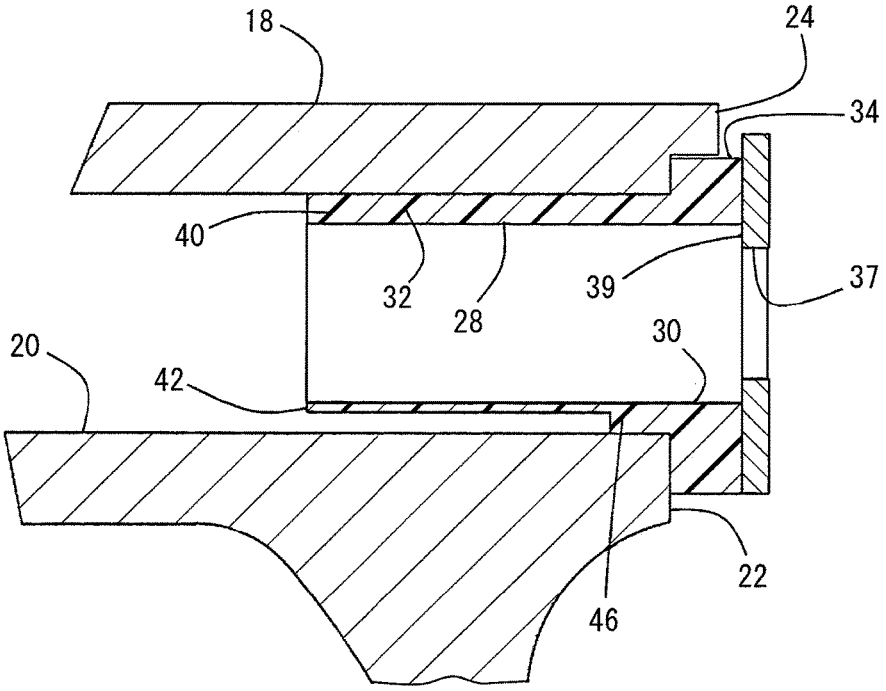
FIG. 14 is a side elevation in cross section of the elastomeric part within the heat exchanger tube.
Figure 15:
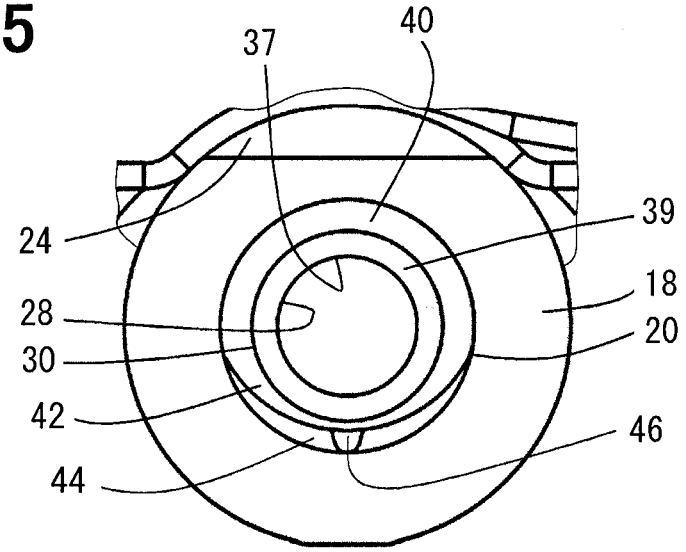
FIG. 15 is a detail front elevation of the header tank of the heat exchanger looking down the tube to view the elastomeric part which has been inserted in the opposite end thereof.
Figure 16:
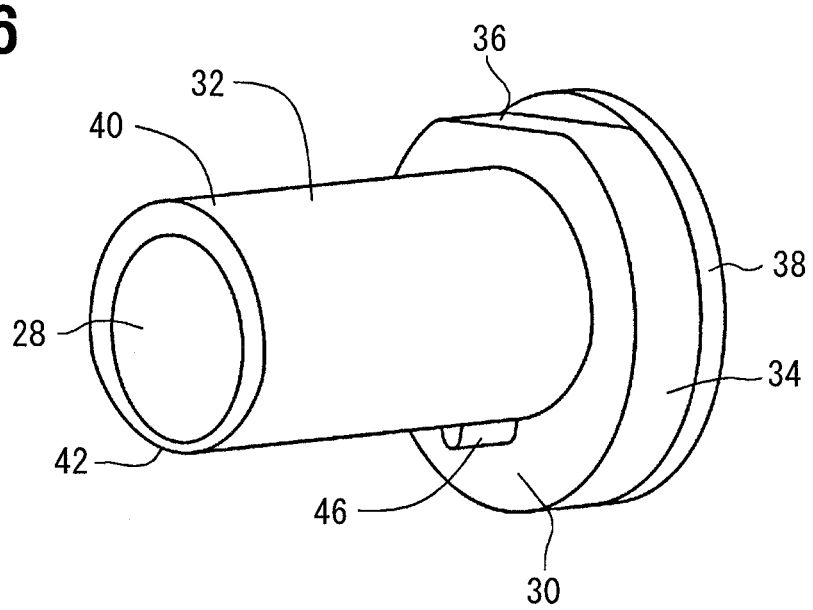
FIG. 16 is a perspective view of the elastomeric part of the embodiment.
Figure 17:
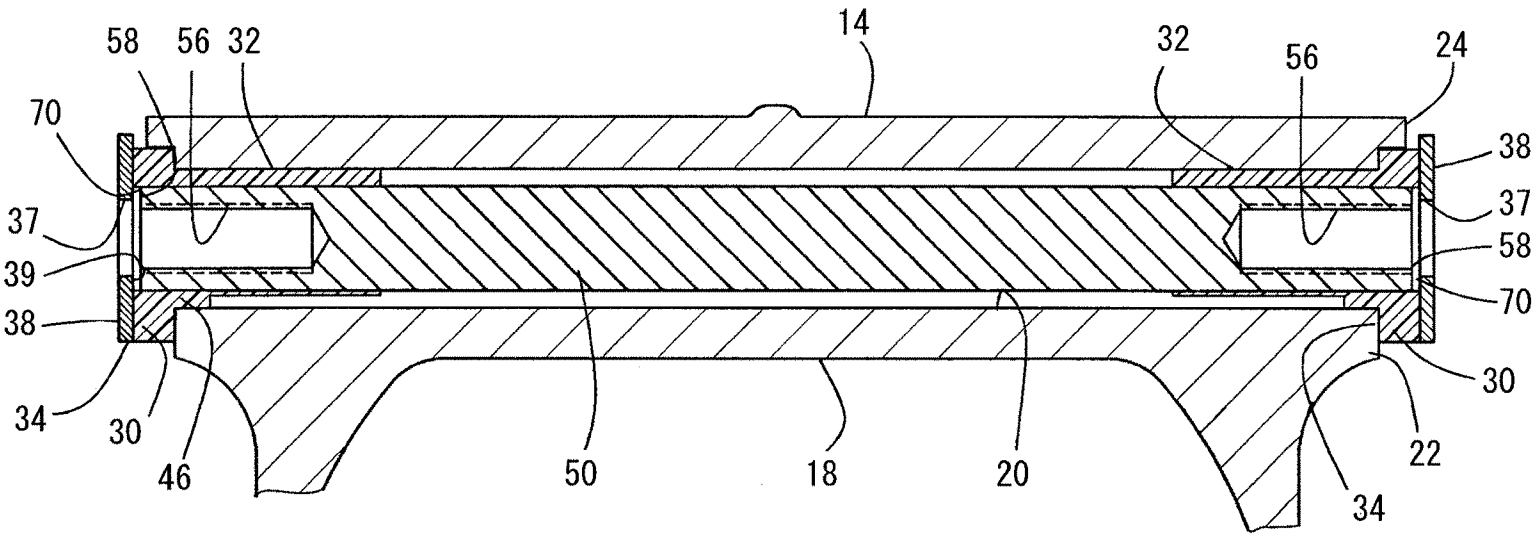
FIG. 17 is a side elevation in cross section through the heat exchanger mounting tube showing the elastomeric pares elongate member in place; and, FIG. 18 is the view of FIG. 17 showing the heat exchanger mounted on the support channel using bolts and washers.

FIG. 9 shows a supporting channel 60 that may be made from steel. The supporting channel 60 is arranged to mount the heat exchanger 10, for example in a vehicle, such as an off highway vehicle. The supporting channel 60 is generally U-shaped, being bent from sheet metal, and the sides of the U form support plates 62 defining apertures 64 to receive the bolts 52. One mounting plate 62 includes a cutaway 66 to receive the part defining the broad mouth (broad opening) 16. FIGS. 10 and 11 show the heat exchanger 10 offered up to the supporting channel 60 so that the ends of the tubes 18 are aligned with the apertures 64 in the mounting plates 62.

In use, then, one elastomeric part 30 is fitted on to one end of the elongate member 50 so that the end face 58 of the elongate member 50 is nearly in contact with the inner face 39 of the metal washer 38. The gap 70 between the end face 58 of the elongate member 50 and the inner face 39 of the washer 38 is 1 mm. The elongate member 50 is then inserted into the bore 20 of a tube 18. Once the elastomeric part 30 is fully inserted, a second elastomeric part 30 is inserted into the opposite end of the bore 20 of the tube 18 and receives the other end of the elongate member 50 within its axial bore 28. Each elastomeric part 30 is rotated so that the flat 36 is aligned with the protrusion 24 so that the elastomeric part 30 can be fully inserted into the bore 20. The protrusion 46 ensures that the axial bore 28 through the elastomeric part 30 is coaxial within the bore 20, and does not sag.

The heat exchanger 10 is then offered up to the support channel (supporting channel) 60. A washer 54 is placed on each bolt 52, and each bolt 52 is inserted through an aperture 64 in the support channel 60, through the washer 38 and is screwed into the screw threaded bore 56 of the elongate member 50. Each support plate (mounting plate) 62 surrounding each aperture 64 is thus clamped between the free washer 54 and the washer 38 attached to the elastomeric part 30 to retain the heat exchanger 10 on the channel 60.

As the bolt 52 is tightened, the gap 70 between the inner face 39 of the washer 38 and the end face 58 of the elongate member 50 will be eliminated. The metal washer 38 will then be hard up against the end face 58 of the elongate member 50 and so no further compression of the elastomeric part 30 can take place. Over compression of the elastomeric part 30 is therefore prevented.

The elastomeric part 30 is situated between the support channel 60 and the tube 18 of the heat exchanger 10 and will reduce transmission of vibration from the support channel 60 to the heat exchanger 10.

Thermal expansion and contraction of the heat exchanger in use will be permitted by resilient compression and expansion of the elastomeric part 30.

It is seen that there are two tubes 18 at the top and two tubes 18 at the bottom of the heat exchanger 10 and that the mounting assembly is the only connection between the heat exchanger 10 and the vehicle or other chassis in which it is mounted.

The washer 38 provides a flat face 30 to spread load when under compression from a bolt 52 and its washer 54.

The primary purpose of each elongate member 50 is to act as a fixing point between the support channel 60 and the heat exchanger 10, but it also has a secondary purpose which is to act as a compression limiter for the elastomeric parts 30.

The extrusion (protrusion) 46 is sufficient to centre the elastomeric part 30 in the bore 20, but small enough that it will not affect the performance of the elastomeric part 30 to take account of thermal expansion.

It is seen that, other than the elastomeric part 30, the mounting assembly consists of standard parts. The washers 38, 54 are standard, the bolts 52 are standard, and the elongate member is a simple solid round cross section bar which can be machined to any length, as desired, then bored and tapped at each end to create the screw threaded bores 56.

In a variant from the present embodiment, the washer 38 is free standing, and the elastomeric part 30 is a simple top hat shape with an axial bore. In that case the protrusion 46, flat 36 and elliptical surface 42 would not be present, and the protrusion 24 on the heat exchanger 10 would not be used. This standardises the componentry still further.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A mounting assembly for mounting a heat exchanger, the mounting assembly comprising:

an elongate member defining a screw threaded axial bore at each end;

a bolt for each screw threaded axial bore; and two elastomeric parts, each elastomeric part being substantially top hat shaped and defining an axial bore to receive one end of the elongate member, such that the mounting assembly can be mounted between two apertured mounting parts by arranging the heat exchanger between the apertured mounting parts, with the elongate member received in a heat exchanger bore through the heat exchanger, and tightening the bolts so that the apertured mounting part is clamped between an end of the elongate member and a bolt head of the bolt, with the elastomeric parts mounting the mounting assembly in the heat exchanger bore so that resilient compression of the elastomeric part allows movement of the heat exchanger with respect to the elastomeric parts;

wherein the elastomeric part comprises a main body and a flange, and one side of the main body of the elastomeric part has a lower thickness than the other;

further wherein the one side with the lower thickness includes a protrusion, and at the protrusion the thickness is the same as the other side.

2. The mounting assembly as claimed in claim 1, wherein the elongate member is a solid bar.

3. The mounting assembly as claimed in claim 1 , wherein the elongate member is a round cross section bar.

4. The mounting assembly as claimed in claim 1, wherein each elastomeric part carries a washer on an end of the flange thereof.

5. The mounting assembly as claimed in claim 4, wherein the washer defines an aperture which is smaller than the axial bore of the elastomeric part and smaller than the cross section of the elongate member.

6. The mounting assembly as claimed in claim 1, wherein the mounting assembly includes a washer to be arranged between the head of the bolt and a mounting part at each end.

7. The mounting assembly as claimed in claim 1, wherein the one side with lower thickness defines a part elliptical outer surface in cross section.

8. The mounting assembly as claimed in claim 1, wherein the one side with lower wall thickness is no more than 80% of the other wall thickness.

9. The mounting assembly as claimed in claim 1, wherein the one side with lower wall thickness is no less than 50% of the other wall thickness.

10. The mounting assembly as claimed in claim 1, wherein the one side with lower wall thickness at its thinnest is in the range 0.5 to 1.25 mm.

11. The mounting assembly as claimed in claim 1, wherein the protrusion extends over less than half of an axial length of the main body.

12. The mounting assembly as claimed in claim 1, wherein the protrusion extends over less than a quarter of an axial length of the main body.

13. The mounting assembly as claimed in claim 1, wherein the elastomeric part defines a key or a key way to fit with a key or a keyway of the heat exchanger to ensure that the elastomeric part is correctly oriented with respect to the heat exchanger about the axis of the bore.

14. The mounting assembly as claimed in claim 13, wherein the flange includes a flat.

15. A combination of the mounting assembly and the heat exchanger according to claim 1, the heat exchanger defining a tube forming the heat exchanger bore to receive the elongate member.

16. The combination as claimed in claim 15, wherein one of the tube and the elastomeric part includes a key and the other includes a keyway.

17. The combination as claimed in claim 16, wherein the elastomeric part includes a flat and the tube includes a protrusion with a flat surface to interengage with the flat in complementary fashion.

18. The combination as claimed in claim 15, wherein each elastomeric member carries a washer, and the elongate member, the elastomeric member and the tube are dimensioned such that when assembled, there is a gap at each end of the mounting assembly between the washer carried by the elastomeric member and the end face of the elongate member.

19. The combination as claimed in claim 18, wherein the gap between an end face of the elongate member and the inner face of the washer is 0.5 to 2 mm.

20. The combination as claimed in claim 18, wherein the gap between an end face of the elongate member and the inner face of the washer is in the range 0.9 to 1.1 mm.

* * * * *